US005181407A

United States Patent [19]

Wu

[11] Patent Number: 5,181,407

[45] Date of Patent: Jan. 26, 1993

[54] CARD LOCK AND A PUNCHABLE KEY CARD

[76] Inventor: Wen-Yin Wu, 2nd Rd. 8th Fl. Room #2, Kaohsiung City, China

[21] Appl. No.: 791,143

[22] Filed: Nov. 13, 1991

[51] Int. Cl.[5] ..... E05B 21/00

[52] U.S. Cl. ..... 70/361; 70/352; 70/276; 70/387; 70/405

[58] Field of Search ..... 70/361, 276, 386, 387, 70/352, 385, 351, 350, 405

[56] References Cited

U.S. PATENT DOCUMENTS

| | | | |
|---|---|---|---|
| 451,616 | 5/1891 | Egelston | 70/387 |
| 2,692,495 | 10/1954 | Verdan | 70/351 |
| 3,595,042 | 7/1971 | Sedley | 70/352 |
| 3,665,740 | 5/1972 | Taniyama | 70/276 |
| 3,705,277 | 12/1972 | Sedley | 70/276 |
| 3,995,460 | 12/1976 | Sedley | 70/387 |
| 4,126,025 | 11/1978 | Miyamae | 70/361 |
| 4,149,394 | 4/1979 | Sornes | 70/387 |
| 4,452,059 | 6/1984 | Sornes | 70/352 |
| 5,025,647 | 6/1991 | Muus | 70/352 |

*Primary Examiner*—Renee S. Luebke
*Assistant Examiner*—D. Boucher
*Attorney, Agent, or Firm*—Bacon & Thomas

[57] ABSTRACT

A card lock and a punchable key card having a key card having through holes in the coordinating locatins to and the same number as long pin tumblers provided in a card lock for unlocking the lock without electric power, and a card lock having a plurality of pin tumblers—some long and some short mixed regularly or irregularly—and a dead bolt mover having through holes for the pin tumblers to fit and move is disclosed. The key card functions to push up the short pin tumblers to make the upper ends of all the pin tumblers become positioned in the same level as the upper surface of the dead bolt mover so that the dead bolt mover can be pushed further inward from the locked position to the unlocked position by the key card to retract the dead bolt to unlock the card lock.

9 Claims, 3 Drawing Sheets

CARD LOCK AND A PUNCHABLE KEY CARD

BACKGROUND OF THE INVENTION

Any sort of locks for anti-theft such as, a door lock, an automobile steering lock, a motorcycle lock, a cabinet lock, a drawer lock, a padlock, etc. should have a locking mechanism and a key to unlock the lock mechanism. And pin tumblers are most widely used as the lock mechanism.

In order to make a locking mechanism more difficult to be illegally unlocked, the number of pin tumblers in a lock are often increased. And the pin tumblers are mostly arranged in a straight line to economize the space available, no matter how many pin tumblers might be used. And a key hole is always needed in spite of the method the pin tumblers are arranged in, and any lock wherein the pin tumblers are provided in a straight line can have almost the same potentiality of being pricked open illegally, only different in difficulty. The more the pin tumblers may be provided in a lock, the larger the size of the lock would be.

SUMMARY OF THE INVENTION

This invention has been devised to supply a sort of card lock without using electric power for unlocking with a key card having a plurality of through holes to be easily carried with a user just as a common credit. And the card lock and the key card in the present invention has been planned to have the following advantages.

1. The key for unlocking is a very thin card of non-magnetism, non-powered just as a common credit card, very convenient to carry, 2. The key card can include a main one which can be stored and from which an auxiliary one can be readily copied and which can be available for daily use and, if the auxiliary one is lost, another can to be easily copied from the main one with a carving knife.

3. The key card has no magnetism, no power source but a long service life.

4. Arrangement and preparation of through holes in the key card and long and short pin tumblers in the card lock needs no power source, and its anti-theft effectiveness is perfect.

5. The punchable holes in the card and the pin tumblers in the card lock can be arranged in 3 or 4 lateral rows, each row having a plurality of holes, for example 6 holes, then 18 holes in total and 18 pin tumblers. And then a large numbers of combinations of the long pin tumblers and the short ones can be planned and provided and the through holes in the key card can be bored coordinating to the locations and the same number of the long pin tumblers. And their location arrangement can be any of a triangular, curved, symemtrical or unsymmetrical, regular or irregular, planar geometrical shapes, to resultant perfect anti-theft safety.

6. The card slot in the card lock exposing outside is of a straight linear planar shape so that a wire or prick-open tools cannot reach in, and in addition, the pin tumblers are provided dispersed in a planer surface and perpendicular to the slot, different from a horizontal linear hole in a conventional lock, almost impossible to prick the short pin tumbers irregularly located all aligned to be illegally opened.

7. The key card is thin and through holes control the pin tumblers, quite different from common flat keys and rod-shaped locks, and the card lock is not funtioned by electric power.

8. The pin tumblers can be arranged in 3 rows with magnets or two rows with springs, located vertical to the slot, without using electric power so that problems caused by power failure or short curcuit never happens to this lock.

9. Unlocking of the card lock is performed by pushing the key card in the slot in the card lock, very simple.

10. It can widely applied to a door lock, a padlock, an automobile steering lock, a cabinet lock, a drawer lock, etc, etc.

DETAILED DESCRIPTION OF THE INVENTION

The key card in the present invention, as shown in FIGS. 1–6 has a special pre-set arrangement of through holes 10 punched out of it to coordinate to the numbers and the locations of long pin tumblers 20 provided in a card lock 2, but no holes are punched at the locations coordinating to short pin tumblers in the card lock. So the ends of the long pin tumblers 20 can fall to fit in the through holes 10 and the ends of the short pin tumblers 20 are pushed up to rest on the surface of the key card 1 when the key card 1 is inserted in a card slot in the card lock 2 to unlock it.

The key card 1 can be made as a main card made of non-magnetic, non-powered and non-ferreous material to be reserved for copying an auxiliary one for daily use by a person, and the auxiliary card is also made of the same material as the main one like a common credit card. So the key card has no projection on both surfaces, very convenient to carry in a pocket or a wallet.

Figure 1:
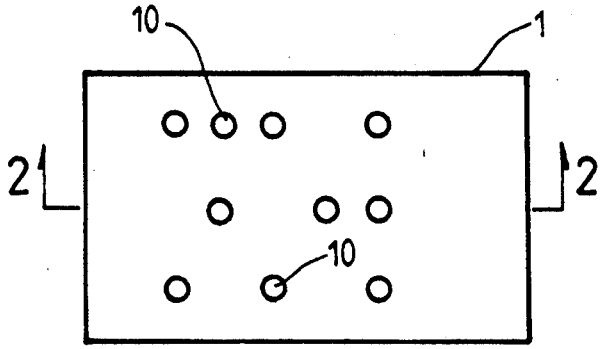
FIG. 1 is a planar view of the first example of the punchable key card in the present invention.
Figure 2:
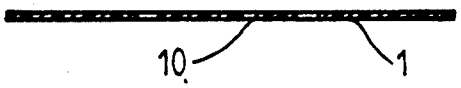
FIG. 2 is a cross-sectional view of 2—2 line in FIG. 1.
Figure 3:
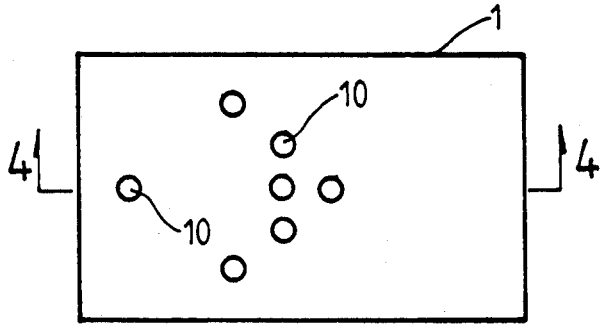
FIG. 3 is a planar view of the second example of the punchable key card in the present invention.
Figure 4:
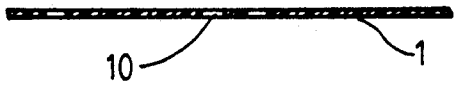
FIG. 4 is a cross-sectional view of 4—4 line in FIG. 3.
Figure 5:
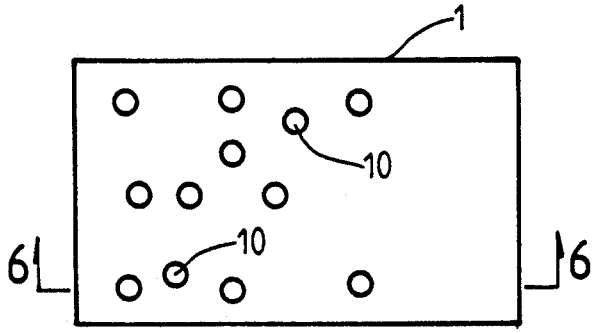
FIG. 5 is a planar view of the third example of the punchable key card in the present invention.
Figure 6:
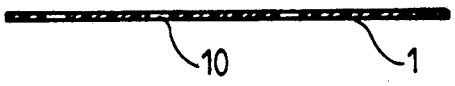
FIG. 6 is a cross-sectional view of the punchable key card in the present invention.
Figure 7:
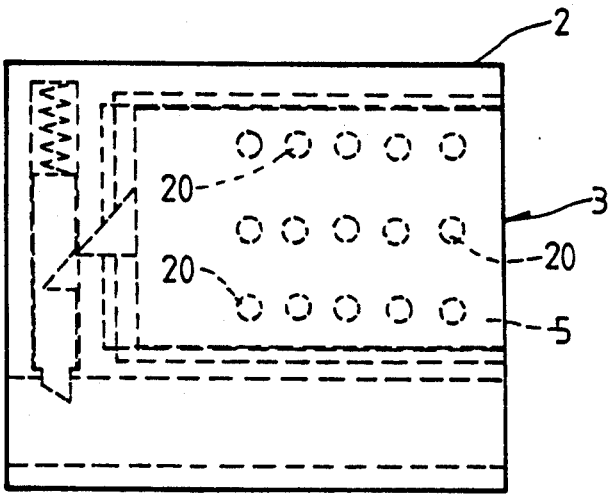
FIG. 7 is a planar view of the card lock coordinating to the first example of the key card shown in FIG. 1.
Figure 8:
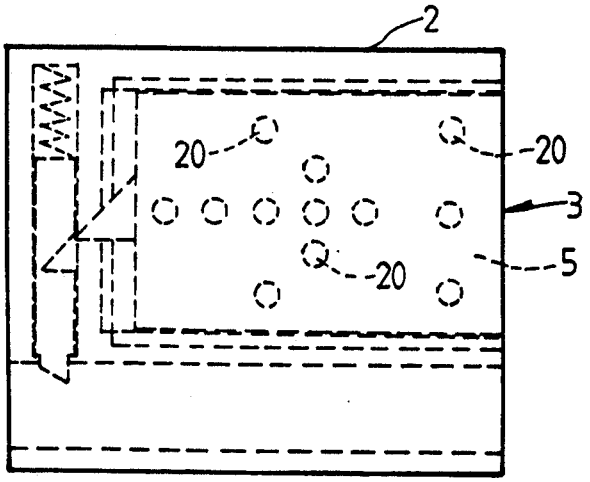
FIG. 8 is a planar view of the card lock coordinating to the second example of the key card shown in FIG. 3.
Figure 9:
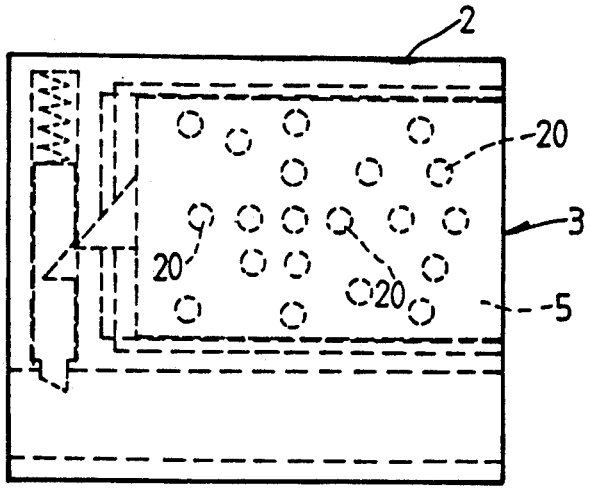
FIG. 9 is a planar view of the card lock coordinating to the third example of the key card shown in FIG. 5.

FIGS. 7, 8, 9 show the card locks 2 respectively coordinating to the key cards 1 shown in FIGS. 1, 3, 5, and the card lock 2 have pin tumblers 20 long and short in a planned locations in 3 or 4 rows of a plurality, for example 6, of pin tumblers in each row. And the coordinating key card 1 has through holes 10 arranged in the same location and number of the long pin tumblers 20 only. The card lock 2 shown in FIG. 10 has pin tumblers 20 with magnetism without a powered mechanism, and that shown in FIG. 11 has pin tumblers 20 without magnetism or a powered mechanism. In other words, the pin tumblers 20 are to be returned to their original position (the locked position) from the unlocked position by means of magnetic force in one kind, and by means of resiliency of springs in another kind. These two kinds of card locks have almost the same effectiveness in the function and action. The card lock 2 having magnetic means shown in FIG. 10 is provided with the same polar magnets 4 buried in the inner lower lengthwise wall and pin tumbler holes 21 in the opposite inner upper lengthwise wall for receiving the pin tumblers 20.

A dead bolt mover 5 is provided to fit movably in the lengthwise cavity between both the upper and the lower wall, having the same number of crosswise through holes 50 as the pin tumbler holes 21 for the pin tumblers 20 long and short to fit therein. The upper ends of the pin tumblers 20 have the opposite polar magnetism to the magnets 4 and magnets 6 are placed on the upper ends of the pin tumblers 20 and extend in the pin tumbler holes 21 so as to attract the ends of the pin tumblers 20. In the locked position the pin tumblers 20 are attracted by the magnets 4 so that the locking magnets 6 on the ends of the pin tumblers 20 may go down to be located partly in the pin tumbler holes 21 and partly in the through holes 50 in the dead bolt mover 5 and consequently the dead bolt mover 5 is kept immovable, with its front end sticking in and stopping the dead bolt in the locked position as shown in FIG. 10.

Figure 10:
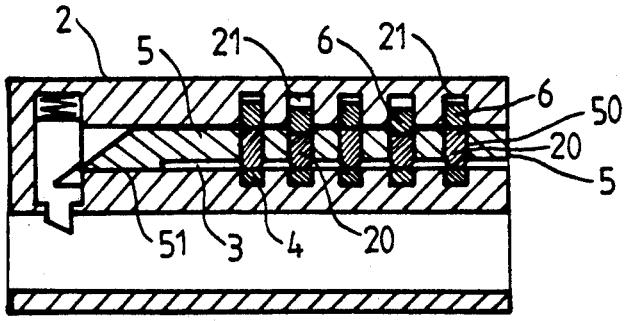
FIG. 10 is a cross-sectional view of the card lock in the locked position in the present invention.
Figure 12:
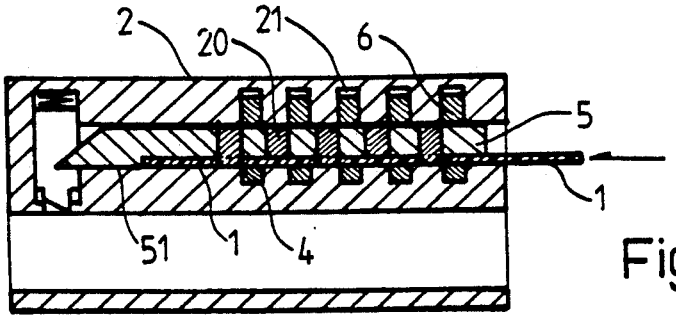
FIG. 12 is a cross-sectional view of the card lock in the unlocked position in the present invention.

FIG. 12 shows the unlocked condition of the card lock 2 shown in FIG. 10 with the key card 1 inserted in the card slot 3. The key card 1 is punched to have through holes 10 arranged just as in the same locations as the long pin tumblers 20 in the card lock 2. When the front edge of the key card 1 has been pushed to come to contact with a recess edge 51 of the dead bolt mover 5 in inserting the card 1 in the card slot 3, the long pin tumblers 50 may fit in the corresponding through holes 20 and the short pin tumblers 20 may be pushed up to sit on the surface of the card 1 so that the upper edges of the long and short pin tumblers 20 and the upper surface of the dead bolt mover can lie in a straight line. Then dead bolt mover 5 with the pin tumblers 20 in its holes 50 can be pushed further inward by the card 1 to the unlocked position and the inclined front end of the dead bolt mover 5 can force the dead bolt to retreat to unlock this lock. The length of each short tumbler is as long as the thickness of the dead bolt mover 5 and that of each long pin tumbler is as long as the thickness of the dead bolt mover 5 plus the thickness of the card 1.

Figure 11:
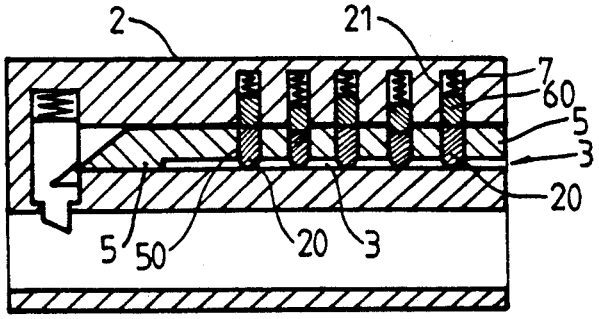
FIG. 11 is another cross-sectional view of the card lock in the locked position in the present invention.
Figure 13:
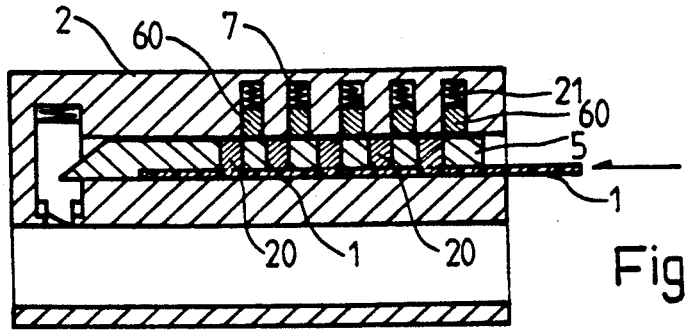
FIG. 13 is another cross-sectional view of the card lock in the unlocked position in the present invention.

Another example of the card lock in the present invention shown in FIG. 11, has the pin tumblers 20 of non-magnetism and no magnets 4 in the lower wall as the first example, but upper pin tumblers 60 and lower pin tumblers 20 and springs 7 on the upper pin tumblers 60 in the pin tumbler holes 21. Then the springs 7 has resilience to function like the magnets 4 in the first example to attract the pin tumblers 20. FIG. 13 shows the movement of the pin tumblers 20, 60, the springs 7 and the dead bolt mover 5 when the card 1 is inserted in the slot 3 in the similar movement shown in FIG. 12.

I claim:

1. A card lock and a punchable key card for use with the card lock comprising:

a card lock including a longitudinally extending cavity therein defining upper and lower lengthwise walls along with first and second longitudinally spaced open ends, a plurality of pin tumbler holes formed in said upper lengthwise wall and opening into said cavity, and a plurality of pin tumblers movably mounted within said plurality of pin tumbler holes, each of said pin tumblers including first and second portions with a predetermined number of the second portions being longer than others such that long and short pin tumblers are defined, said card lock further including a bore formed therein into which the second end of said cavity opens;

a dead bolt slidably mounted within said bore and movable between a locked position and an unlocked position;

a dead bolt mover slidably mounted within said cavity, said dead bolt mover including first and second longitudinally spaced ends and a plurality of through holes adapted to receive said plurality of pin tumblers, the first end of said dead bolt mover being adapted to project into said bore and engage said dead bolt to shift said dead bolt from said locked position into said unlocked position in response to sliding of said dead bolt mover within said cavity, said dead bolt mover also defining a slot between the lower lengthwise wall of said card lock and a lower surface portion of said dead bolt mover with said slot opening at the first end of said cavity; and a punchable key card including a top surface, said key card further including a plurality of through holes formed therein at predetermined positions with said through holes corresponding in number to the number of long pin tumblers such that, in the locked position, the first portion of the short pin tumblers extend into corresponding through holes in said dead bolt mover and pin tumbler holes in said card lock so that the dead bolt mover is kept immovable with the dead bolt in the locked position, and whereby when said key card is inserted into said slot, the second portions of the short pin tumblers engage the top surface of said key card and are pushed up by said key card while the second portions of the long pin tumblers extend into the corresponding through holes in said key card such that the first portions of both of the short and long pin tumblers are substantially level with the upper surface of the cavity wherein the card engages said dead bolt mover causing said dead bolt mover to slide within said cavity, to engage said dead bolt, and the cause shifting of said dead bolt to its unlocked position.

2. The card lock and punchable key card as claimed in claim 1, wherein the key card is formed from a material selected from the group of a non-ferrous material, a non-magnetic metal, plastics, and a non-metal material.

3. The card lock and a punchable key card as claimed in claim 1, wherein said pin tumblers are parallel with one another and spaced apart in the inner upper lengthwise wall, extend through the through holes in the dead bolt mover and rest on the inner lower lengthwise wall of the cavity when the card lock is in the locked position.

4. The card lock and a punchable key card as claimed in claim 1, wherein the pin tumblers in the card lock are arranged in a planar surface in a predetermined geometrical shape.

5. The card lock and a punchable key card as claimed in claim 1, wherein the dead bolt mover to be moved by the key card has its upper lengthwise side in contact with the inner upper lengthwise wall of the card lock.

6. The card lock and a punchable key card as claimed in claim 1, wherein the inner lower lengthwise wall facing the card slot in the card lock is provided with magnets of the same number and corresponding locations to the pin tumbler holes in the inner upper lengthwise wall, and at least the second portions of the long and short tumblers are formed from a magnetically attractable material.

7. The card lock and a punchable key card as claimed in claim 1, wherein springs are provided within the pin tumbler holes formed in said card lock to resiliently bias said pin tumblers in the direction of the lower lengthwise wall.

8. The card lock and a punchable key card as claimed in claim 1, wherein said dead bolt mover includes a recessed edge for engagement by the key card.

9. The card lock and a punchable key card as claimed in claim 1, wherein said short pin tumblers are as long as the thickness of the dead bolt mover and the long pin tumblers are as long as the thickness of the dead bolt mover plus the thickness of the key card.

* * * * *